US011573067B1

(12) United States Patent
Faircloth, Jr.

(10) Patent No.: US 11,573,067 B1
(45) Date of Patent: Feb. 7, 2023

(54) WEARABLE SELF-DEFENSE SPRAY SYSTEM AND METHOD OF USE

(71) Applicant: Michael Lynn Faircloth, Jr., Minneapolis, MN (US)

(72) Inventor: Michael Lynn Faircloth, Jr., Minneapolis, MN (US)

( * ) Notice: Subject to any disclaimer, the term of this patent is extended or adjusted under 35 U.S.C. 154(b) by 0 days.

(21) Appl. No.: 17/475,251

(22) Filed: Sep. 14, 2021

(51) Int. Cl.
*F41H 9/10* (2006.01)

(52) U.S. Cl.
CPC ..... *F41H 9/10* (2013.01)

(58) Field of Classification Search
CPC ..... F41H 9/10; A44C 15/002; A44C 9/0061; A44C 5/0007; A44C 5/003; B65D 83/752; B65D 83/384; A61K 9/12
See application file for complete search history.

(56) References Cited

U.S. PATENT DOCUMENTS 5,924,601 A * 7/1999 Chen ..... F41H 9/10 222/78
6,340,242 B1 * 1/2002 Sandidge ..... G04B 37/127 368/278
10,219,980 B2 * 3/2019 Scott ..... A45C 11/24
2017/0122708 A1 * 5/2017 Gorinas ..... A61K 31/165
2018/0078011 A1 * 3/2018 Parker ..... B05B 11/048
2021/0393814 A1 * 12/2021 Klepfisz ..... A61L 2/0088

* cited by examiner

*Primary Examiner* — Vishal Pancholi
*Assistant Examiner* — Robert K Nichols, II
(74) *Attorney, Agent, or Firm* — H. Brock Kolls

(57) ABSTRACT

The present invention relates to a wearable self-defense spray system and method of use. The system comprising a wristband having a cartridge bay, a band, and a clasp that interconnects to secure the wristband around a wrist of a consumer. A cover fastens across the back surface to seal the body closed. A spray canister is pressurized with a self-defense spray liquid and snuggly fits into the cartridge bay in a non-slip, non-rotating manner. The spray canister has an egress port through which by depressing the spray valve the self-defense spray liquid egresses the spray canister in the direction of a threat such as a person, animal, or other threat. In exemplary embodiments, the wristband and spray canister can be scaled in dimension to fit the finger of a consumer as a ring or hung on a cord or chain and worn as a necklace around neck of the consumer.

20 Claims, 10 Drawing Sheets

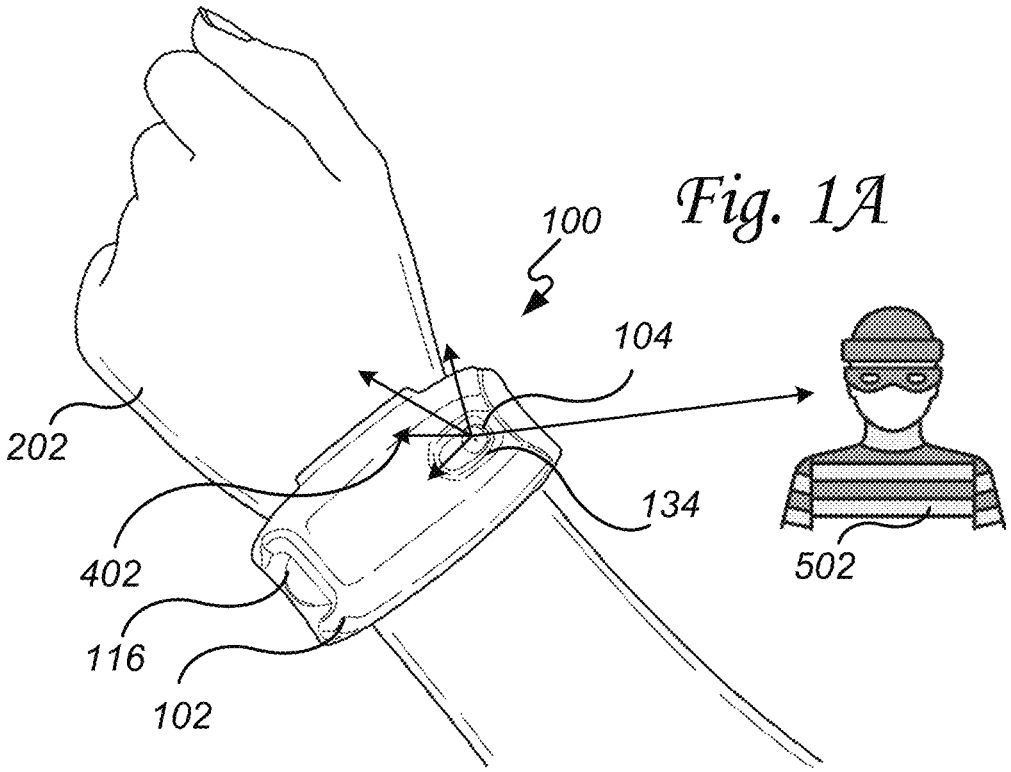
Fig. 1A
Fig. 1B
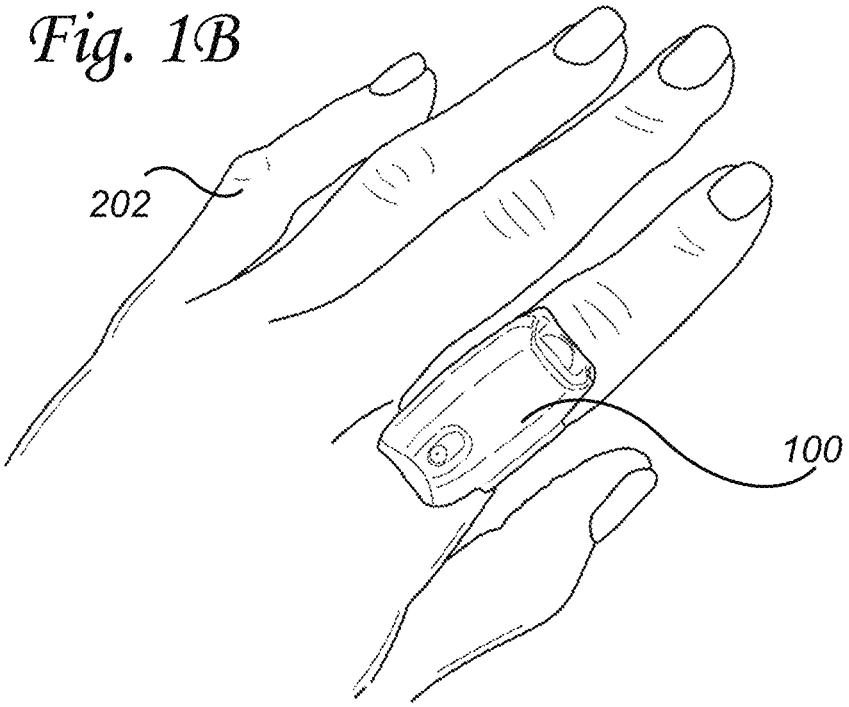

WEARABLE SELF-DEFENSE SPRAY SYSTEM AND METHOD OF USE

TECHNICAL FIELD OF THE INVENTION

This invention relates to a wearable self-defense spray system and method of use, and particularly to a system comprising a wristband having a cartridge bay, a band, and the clasp that interconnects to secure the wristband around a wrist of a consumer, scaled in dimension along with the spray canister to fit a finger of a consumer, or configured to hang from a cord or chain around the neck of a consumer. A cover fastens across the back surface to seal the body closed. A spray canister is pressurized with a self-defense spray liquid and snuggly fits into the cartridge bay in a non-slip, non-rotating manner. The spray canister has an egress port through which by depressing the spray valve the self-defense spray liquid egresses the spray canister in the direction of a threat such as a person, animal, or other threat.

BACKGROUND OF THE INVENTION

Before our invention, a consumer could carry a self-defense spray in their purse or pocket. While these can be suitable locations to store a self-defense spray it can be difficult to access and use the spray in response to an immediate threat such as against an attacking person, animal, or other threat. In this regard, often success in thwarting a threat is dependent on the speed that the consumer can access and dispense the self-defense spray in the direction of the attacker. The quicker the better. However, sprays stored in concealed places like pockets and purses can be difficult to reliably access in an emergency. So, while the consumer has the spray in their possession it may not get used in time to thwart an attack simply because the consumer couldn't act quickly enough to access and dispense the spray in the direction of the attacker. In support of this, in law enforcement there is a 21-foot rule that is a measure of distance that related to the time it would take an officer to recognize a threat, draw a sidearm, and fire two rounds center mass against an attacker charging with a knife or other stabbing weapon. This impacts the reaction time as an attacker with a knife can close a distance of seven yards in about 1.5 seconds.

In addition, sprays that are on keychains can be heavy and bounce around when worn or carried by the consumer during motion such as when walking, running, or exercising. In addition, keychains that require the consumer to hold in their hand prevent the consumer from using their hand during activities. Such encumbrances as having to hold the spray in their hand can make the consumer think twice about carrying the spray at all.

The present invention addresses these and other shortcomings by providing a wearable self-defense spray system, method of use, and other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a wearable self-defense spray system comprising a wristband. The wristband and spray canister can be scaled in dimension to fit around the finger of a consumer as a ring.

The wristband can also be configured to hang on a cord or chain and worn as a necklace around the consumer's neck.

The wristband comprising a body having a front exterior surface, and an interior surface, a cartridge bay, and a cover that fastens across the interior surface to seal the body closed. The front exterior surface having an egress aperture therethrough that extends into the cartridge bay. The cover comprising a plurality of flexible pegs positioned proximate to the perimeter of the cover. A rib is integrally formed around the circumference of the plurality of the flexible pegs. A plurality of flexible peg receptacles is integrally formed on the interior surface around the periphery of the cartridge bay. A retaining band is integrally formed around the interior circumference of the plurality of flexible peg receptacles. The rib engages, sliding past the retaining band fastening the cover closed on the interior surface of the wristband. The retaining band prevents the rib from egressing the plurality of flexible peg receptacles until the consumer pulls the cover open.

A spray canister comprising a spray valve having an egress port, and a self-defense spray liquid inside the spray canister. The spray canister is pressurized and is profiled in shape to snuggly fit into the cartridge bay in a non-slip, non-rotating manner. The egress port is orientated such that by depressing the spray valve the self-defense spray liquid egresses the spray canister through the egress port and the egress aperture. The self-defense spray liquid can be sprayed by the consumer in the direction of a threat such as a person, animal, or other threat by pressing the spray valve.

Additional shortcomings of the prior art are overcome and additional advantages are provided through the provision of a wearable self-defense spray system. The wearable self-defense spray system comprising a wristband. The wristband comprising a body having a front exterior surface, and a back surface. An interior surface of the body comprises a cartridge bay. A band is attached to one end of the body having a plurality of holes disposed along the length of the band. A clasp is attached to the opposite end of the body. The band and the clasp interconnect to secure the wristband around a wrist of a consumer. A cover fastens across the back surface to seal the body close. The front exterior surface has an egress aperture therethrough that extends into the cartridge bay.

A spray canister has an open end. The spray canister comprises a neck ring around the open end. A spray valve has an egress port that is fitted over the neck ring and crimped sealing a self-defense spray liquid inside the spray canister. The spray canister is pressurized and is profiled in shape to snuggly fit into the cartridge bay in a non-slip, non-rotating manner. The egress port is orientated such that by depressing the spray valve the self-defense spray liquid egresses the spray canister through the egress port and the egress aperture. The self-defense spray liquid can be sprayed by the consumer in the direction of a threat such as a person, animal, or other threat by pressing the spray valve.

Additional shortcomings of the prior art are overcome and additional advantages are provided through the provision of a method of using a wearable self-defense spray system. The method comprising the step of opening a wristband. The wristband comprising a body having a front exterior surface, and a back surface. An interior surface of the body comprising a cartridge bay. A band attaches to one end of the body and has a plurality of holes disposed along the length of the band. A clasp attaches to the opposite end of the body. The band and the clasp interconnect to secure the wristband around a wrist of a consumer. A cover fastens across the back surface to seal the body closed. The front exterior surface having an egress aperture therethrough that extends into the cartridge bay.

The method continues with the step of inserting a spray canister. The spray canister has an open end. The spray canister comprises a neck ring around the outer circumference of the open end. A spray valve has an egress port and is fitted over the neck ring and crimped, sealing a self-defense spray liquid inside the spray canister. The spray canister is pressurized and is profiled in shape to snuggly fit into the cartridge bay in a non-slip, non-rotating manner. The egress port is orientated such that by depressing the spray valve the self-defense spray liquid egresses the spray canister through the egress port and the egress aperture.

The method continues with the step of dispensing the self-defense spray liquid. The body further comprises a pliable actuator surface on the exterior surface proximate to the egress aperture opposite the spray valve. The pliable actuator surface is flexed by a finger of the consumer to depress the spray valve releasing the self-defense spray liquid at a threat such as a person, animal, or other threat.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIGS. 1A-1C illustrates examples of a wearable self-defense spray system;

The detailed description explains the preferred embodiments of the invention, together with advantages and features, by way of example with reference to the drawings.

DETAILED DESCRIPTION OF THE INVENTION

Figure 1C:
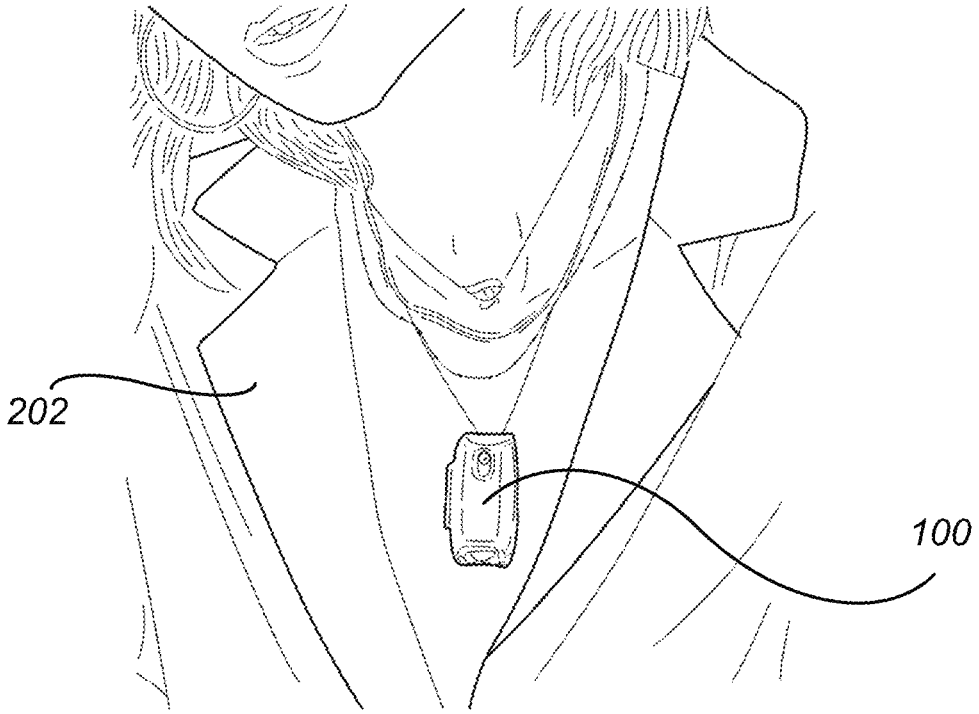

Turning now to the drawings in greater detail, it will be seen that in FIGS. 1A-1C there is illustrated one example of a wearable self-defense spray system 100. In an exemplary embodiment, FIG. 1A is a flexible wristband 100 comprising a self-defense spray canister that can be strapped to the wrist of a consumer 202. In another exemplary embodiment, in FIG. 1B the wristband and the spray canister can be scaled in dimension to fit around the finger of a consumer as a ring. In yet another exemplary embodiment, FIG. 1C the wristband can be hung on a cord or chain and worn as a necklace around the neck of the consumer.

The wristband 100 can be fabricated from an elastomer, plastic, polymer, rubber, neoprene, cloth, or types or kinds of other soft, flexible, durable, sweat-resistant, or water-resistant materials, as may be required and/or desired in a particular embodiment. Alternatively, while the body 102 of the wristband can be fabricated from materials that easily allow the consumer to depress the spray valve 138 by depressing the pliable actuator surface 146 area causing the spray valve 138 to depress releasing the self-defense spray 402 through the egress port 104, other materials such as leather, braided materials, metals, or other types or kinds of materials can be used. As an example, and not a limitation, the band end 110 and the clasp end 112 can be fabricated from one type or kind of material such as leather and the body 102 can be fabricated from an elastomer.

The spray canister 108 comprises a spray valve 138 that has an egress port 104. The spray canister 108 comprises a self-defense spray liquid 402 that can be dispensed by the consumer 402 by depressing the spray valve 138. In operation, the consumer 402 can dispense the self-defense spray liquid 402 by pressing the spray valve 138 when they feel threaten 502 by a person, animal, or on other occasions, as may be required and/or desired in a particular embodiment.

In an exemplary embodiment, the self-defense spray liquid 402 can be pepper spray, mace, an eye irritant, a nerve agent, a breathing irritant, a threat immobilizing solution, or other types or kinds of self-defense spray liquids, as may be required and/or desired in a particular embodiment.

Figure 2:
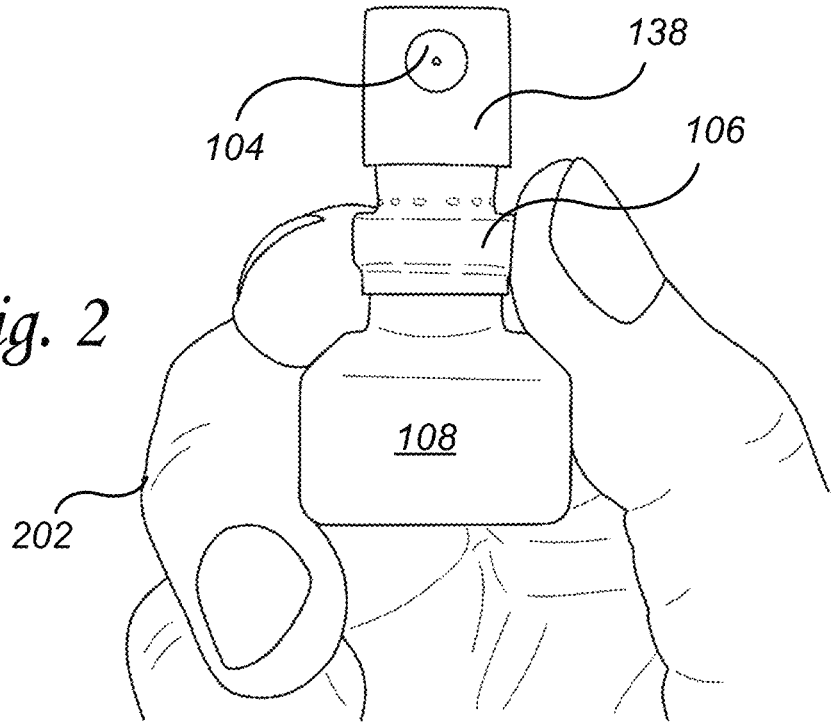
FIG. 2 illustrates one example of a spray canister that is part of a wearable self-defense spray system.

Referring to FIG. 2, there is illustrated one example of a spray canister 108 that is part of a wearable self-defense spray system 100. In an exemplary embodiment, the spray canister 138 comprises an open end 152. The spray canister further comprises a neck ring 106 around the exterior circumference of the open end 152. The neck ring 106 is better illustrated in at least FIG. 3.

The spray valve 138 comprises an egress port 104 and is fitted over the neck ring 106 and crimped sealing a self-defense spray liquid 104 inside the spray canister 108. The spray canister 108 is pressurized and is profiled in shape to snuggly fit into the cartridge bay 122. The cartridge bay 122 is better illustrated in at least FIG. 6.

When snuggly fitted into the cartridge bay 122, the spray canister 108 is securely held in a non-slip, non-rotating manner such that the egress port 104 is orientated to dispense the self-defense spray liquid 104 through the egress port 104 and the egress aperture 134 in the wristband 100. In this regard, the egress port 104 of the spray valve 138 is position directly behind the egress aperture 134 in the wristband 100 front surface 102, and the canister bay 122 snuggly secures the spray canister 108 in a non-slip non-rotating manner to ensure this alignment for the self-defense spray liquid can be easily dispensed in the direction of a treat 502 without being encumbered by the wristband 100. In operation, the self-defense spray liquid is dispensed by the consumer 202 by depressing the pliable actuator 146 that is located on top of the spray valve 138 when the spray canister 108 is inserted into the cartridge bay 122.

Figure 3:
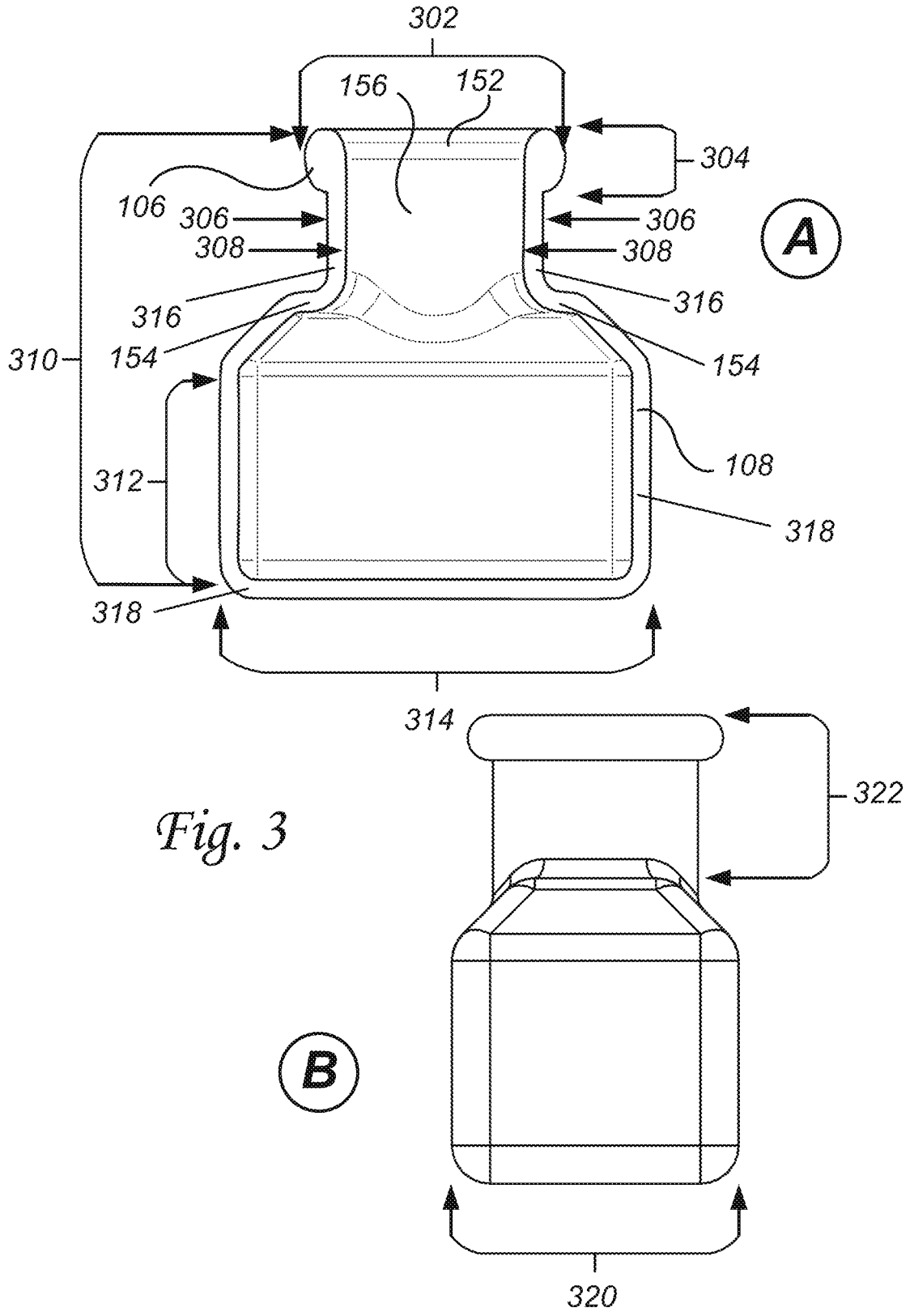
FIG. 3. illustrates one example of a cross-sectional front view reference 'A' and a cross-sectional side view reference 'B'.

Referring to FIG. 3, there is illustrated one example of a cross-sectional front view reference 'A' and a cross-sectional side view reference 'B' a spray canister 108. In an exemplary embodiment, and with reference to the front view reference 'A', the spray canister 108 neck ring 106 outer diameter 302 is in the range of 10 millimeter (mm) to 16 mm and preferable in the range of 13 mm to 14 mm. Furthermore, the spray canister 108 neck ring 106 width 304 is in the range of 2 mm to 5 mm and preferably in the range of 3.2 mm to 3.4 mm. The neck 156 wall outer diameter 306 is in the range of 9 mm to 14 mm and preferably in the range of 10 mm to 12 mm. The neck 156 wall inner diameter 308 is in the range of 8 mm to 11 mm and preferably in the range of 9 mm to 10 mm. The neck 156 wall thickness 316 is in the range of 0.5 mm to 2.5 mm and preferably in the range of 0.75 mm to 1.1 mm. The cross-sectional canister thickness 318 is in the range of 0.5 mm to 2.5 mm and preferably in the range of 0.75 mm to 1.1 mm.

The neck 156 wall thickness 316 and the cross-sectional canister thickness 318 are selected based on factors that include the ability to withstand column loading when the spray nozzle 138 is press-fitted and crimped around the neck ring 106. In this regard, the neck ring 106, neck wall thickness 316, neck ring diameter 302, neck ring thickness 304, spray canister thickness 318, and overall canister 108 strength is selected to withstand the column loading forces downward on the spray valve 138 and canister 108 plus the crimping forces as to not crush or dent the canister 108 when the spray valve 138 is applied to the canister 108 and crimp sealed in an airtight leak-proof manner.

Other spray canister 108 design parameters and factors include suitable wall thickness to allow the spray canister 108 to be pressurized with inert gases, refrigerants such as freon, R-134A, or other refrigerants, butane, or other suitable propellants and gas-impermeable barrier properties of the wall thickness and material enough to prevent the pressurized charge from diminishing or oxygen ingress over time through the spray canister walls.

Such inert gas can be nitrogen or other inert gas. Such pressurization can be in the 80 pounds per square inch (psi) to 150 psi and preferably in the 110 psi to 125 psi. In operation, the pressurized charge pressure can be selected based on how far it is desired for the self-defense spray 402 to be projected from the egress port.

Since subduing a threat 502 such as a person, animal, or other threat can be easier from a distance, the pressurized spray canister 108 has a directed egress port 104 that is configured and optimized to spray the self-defense spray liquid 402 in the range of 10 feet to 25 feet and preferably in the range of 3 feet to 5 feet dependent on the dispersal spray pattern implemented. The filled and pressurized spray canister 108 shelf-life is measured in years without degradation of the self-defense spray liquid 104 or reduction in the pressurized charge amount.

The spray canister length 310 is in the range of 20 mm to 30 mm and preferably in the range of 24 mm to 25 mm. The spray canister width 314 is in the range of 18 mm to 26 mm and preferably in the range of 21 mm to 23 mm. With reference to the side view 'B', the spray canister side width 320 is in the range of 11 mm to 18 mm and preferably in the range of 13 mm to 16 mm. The spray canister neck 156 length 322 is in the range of 6 mm to 10 mm and preferably in the range of 8 mm to 9.5 mm.

The spray canister neck 156 is open on one end 152 and has the neck ring 106 around the outer circumference of the open end 152. At the other end of the spray canister neck, 156 is an integrally formed contoured shoulder 154. The contoured shoulder 154 is curved to receive the raised neck ridge 148 that is integrally formed on the interiors surface of the cartridge bay 122. In this regard, the cartridge bay 122 comprises the raised neck ridge 148 which is integrally formed along the surface of the cartridge bay, wherein when the spray canister 108 is inserted into the cartridge bay the raised neck ridge 148 engages the neck 156 contoured shoulders 154 of the spray canister 108 preventing it from sliding away from the force of the finger of the consumer 202 when the spray nozzle is pressed.

In an exemplary embodiment, the spray canister 108 can be made of nylon, polymer, metal, or other suitable materials that have a low gas permeability rating and superior gas barrier properties such that the pressurized propellant charge does not dissipate or oxygen ingress through the spray canister 108 walls over time. Such propellants can include inert gases, refrigerants such as freon, R-134A, or other refrigerants, butane, or other suitable propellants. Additionally, the spray valve 138 can be made of a combination of nylon, polymer, metal, or other suitable materials.

The end portion of the spray valve 138 that fits over the spray canister 108 neck ring 106 can be made of a pliable metal that can be easily crimped forming a robust and durable pressurized airtight leak-free seal between the spray valve 138 and the spray canister 138 neck ring 106.

Figure 4:
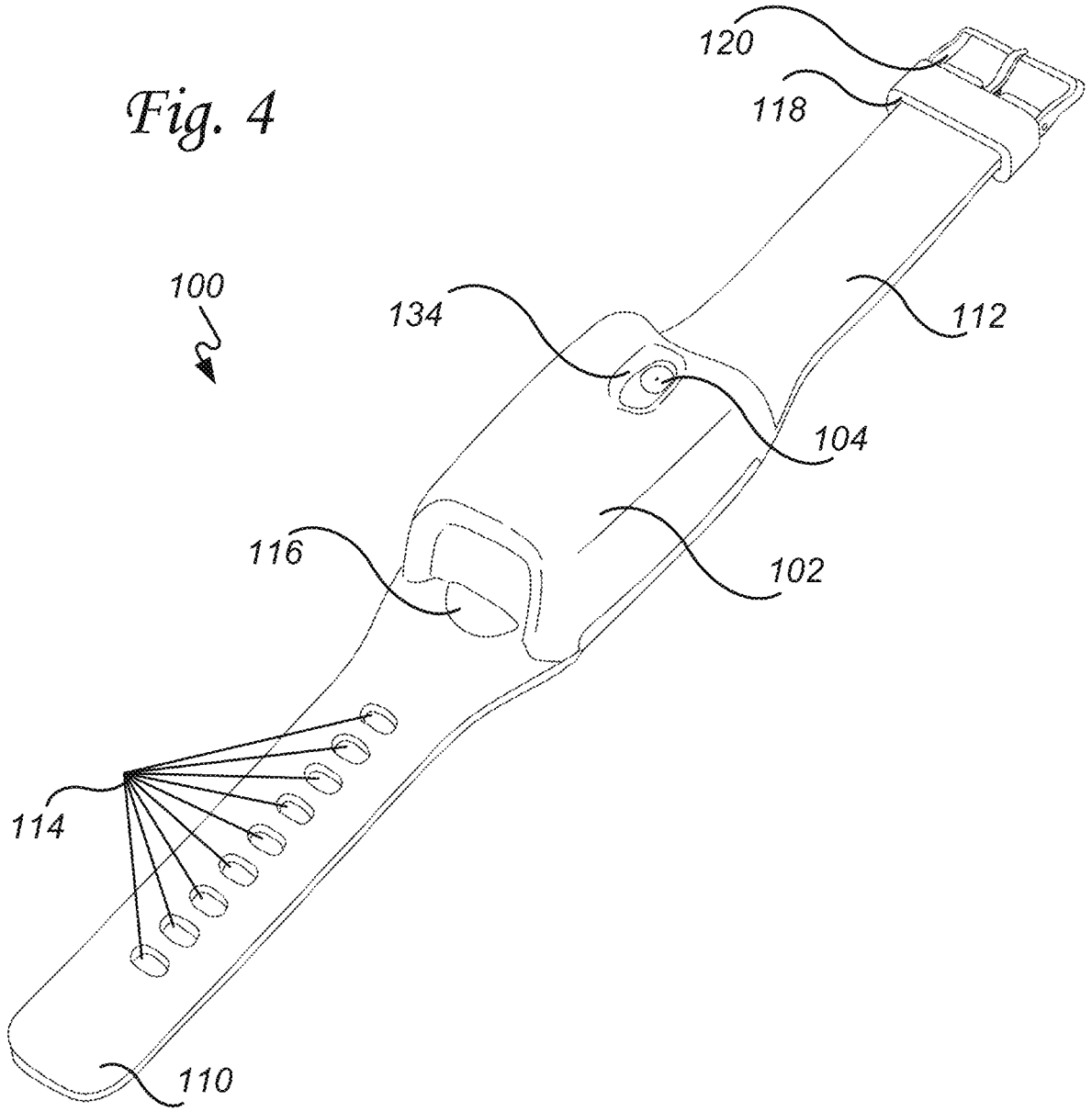
FIGS. 4-5 illustrate examples of a top perspective view of a wearable self-defense spray system.
Figure 5:
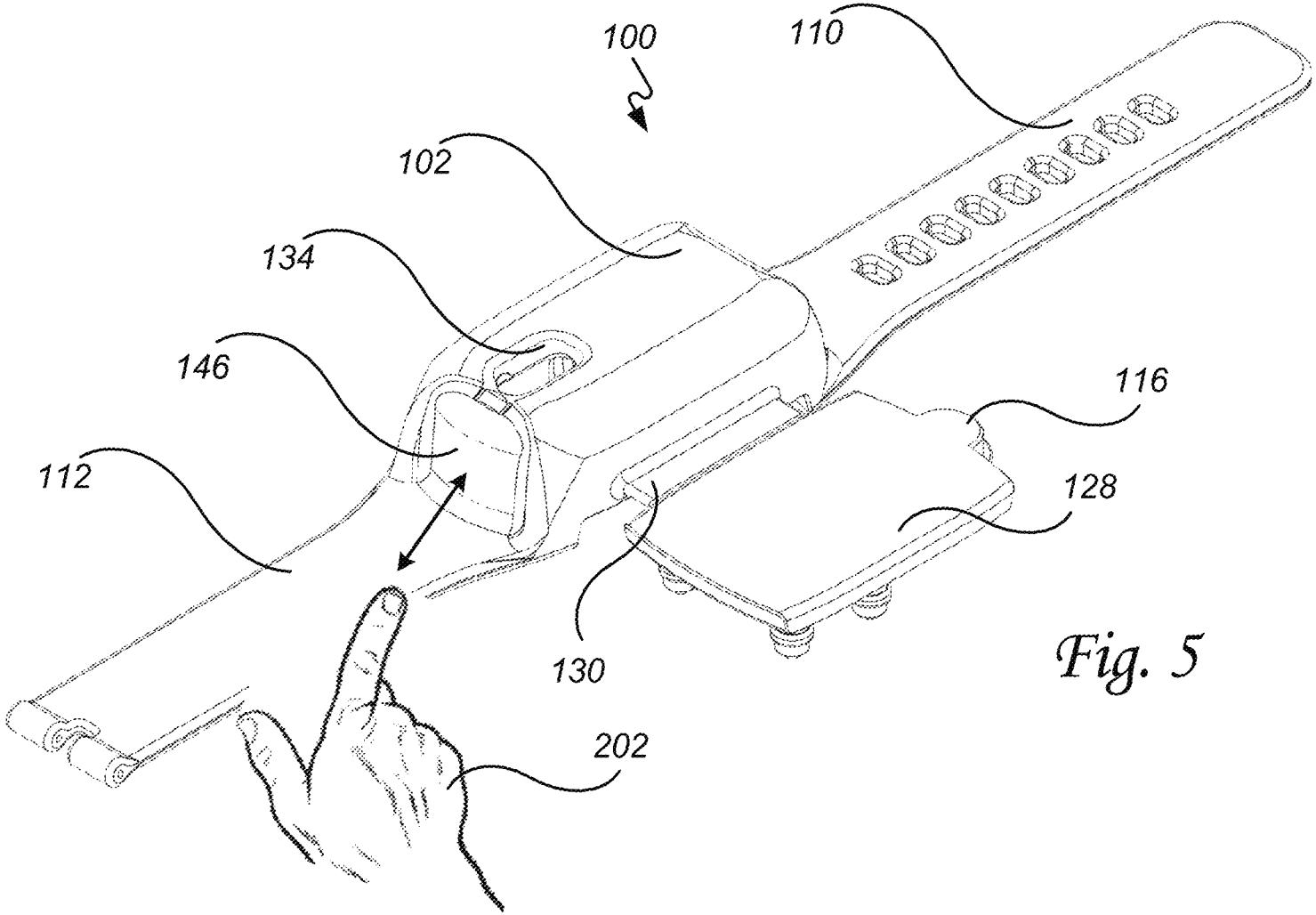

Referring to FIGS. 4 and 5, there is illustrated one example of a top perspective view of a wearable self-defense spray system 100. In an exemplary embodiment, a wristband 100 comprising a body 102 having a front exterior surface, a back surface better illustrated in at least FIGS. 6 and 8, an interior surface 162 comprising a cartridge bay 122. A band 110 is attached to one end of body 102 and body 102 has a plurality of holes 114 disposed along the length of the band end that is used to tighten the wristband around the wrist of the consumer. A clasp 112 is attached to the opposite end of the body 102. The clasp 112 has at one end a buckle 120 and a retaining band 118 wherein the free end of the band 110 can be secured by the buckle 120 and slid under the retaining band to neatly manage the loose end of the band 110. In this regard, the band 110 and the clasp 112 interconnect by way of the buckle 120 to secure the wristband around a wrist of a consumer.

In an exemplary embodiment, a cover 128 fastens across the back interior surface 162 to seal the body 102. The front exterior surface 102 has an egress aperture 134 therethrough that extends into the cartridge bay 122.

With reference to FIG. 5, body 102 further comprises a pliable actuator surface 146 on the exterior surface 102 proximate the egress aperture 134 opposite the top of the spray valve 138 when inserted into the cartridge bay 122. The pliable actuator surface 146 can be flexed by a finger of the consumer 202 to depress the spray valve releasing the self-defense spray liquid 402.

In an exemplary embodiment, an integrally formed hinge 130 connects one edge of the cover 128 with one edge of the body 102 edge such that the cover 128 remains flexibly attached to the body 102 and is repositionable to open and close the cartridge bay 122.

Figure 6:
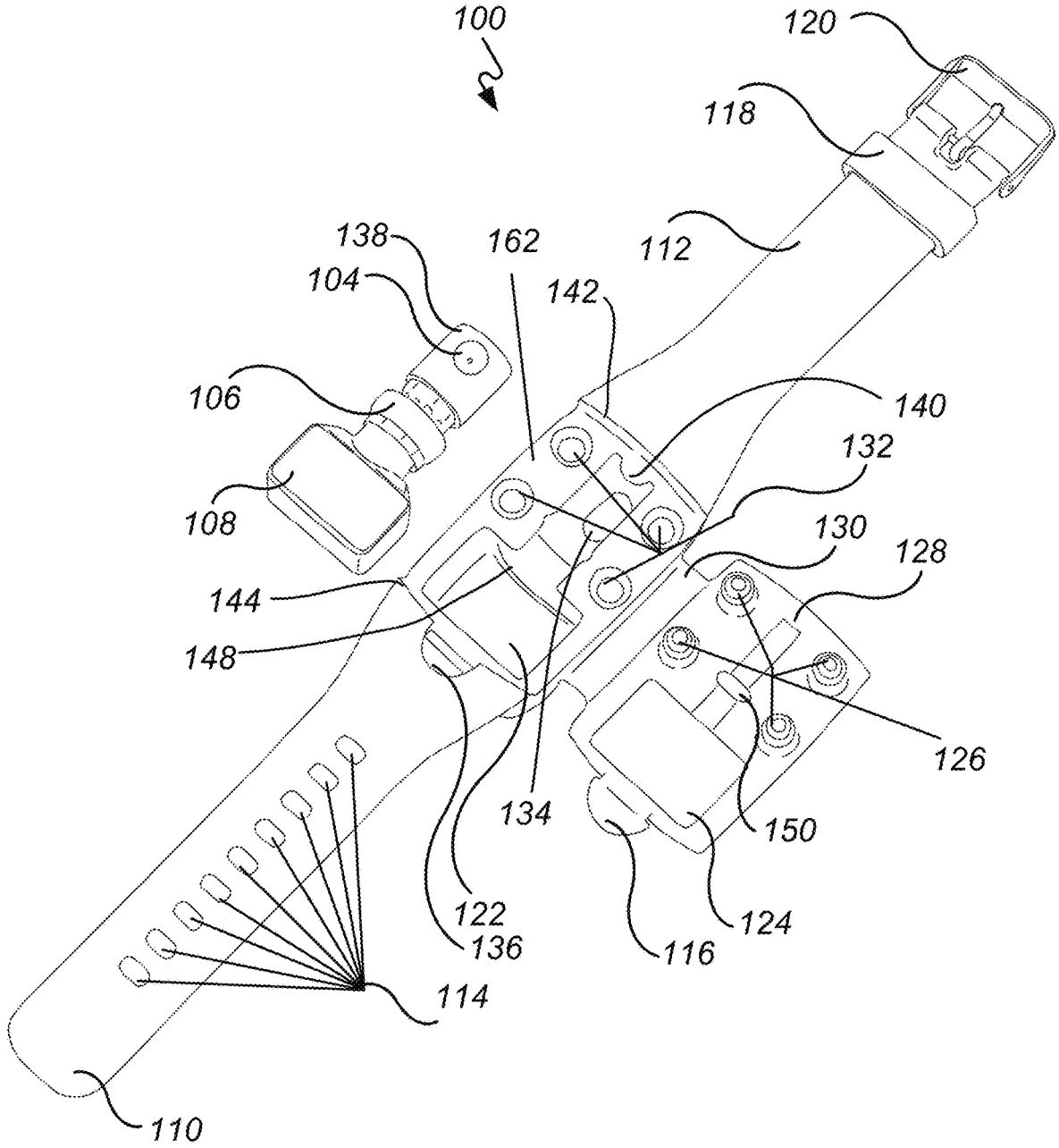
FIG. 6 illustrates one example of a bottom perspective view of a wearable self-defense spray system.

In an exemplary embodiment, cover 128 has an integrally formed tab 116 along the perimeter edge that effectuates the ability to open cover 128 by pulling the tab 116. The band 110 has a tab recess 136 for receiving tab 116 when cover 128 is closed. FIG. 4 better illustrates the tab 116 fitted into the tab recess 136 with the cover 128 closed in at least FIG. 4. FIG. 6 better illustrates the tab recess 136 and the band 110 end proximate the body 102 where the band 110 and the body interconnect.

Referring to FIG. 6, there is illustrated one example of a bottom perspective view of a wearable self-defense spray system 100. In an exemplary embodiment, the cartridge bay 122 has a spray nozzle end and a canister end. The spray nozzle end having a nozzle tab 140 that extends from the perimeter of the interior surface 162 to cover a portion of the spray canister nozzle 138 when the spray canister 138 is inserted into the cartridge bay 122. In this regard, the nozzle tab 140 applies pressure to hold the spray nozzle 138 tight within the cartridge bay 122 when cover 128 is closed.

In an exemplary embodiment, the cartridge bay 122 has a raised neck ridge 148 that is integrally formed along the surface of the cartridge bay 122. The raised neck ridge 148 is positioned such that when the spray canister 138 is inserted into the cartridge bay 122 the raised neck ridge 148 engages the contoured shoulder 316 of the neck 156 of the spray canister 108 preventing it from sliding away from the force of the finger of the consumer 202 when the spray nozzle 138 is pressed. The raised neck ridge 148 is also viewable in at least FIGS. 7 and 8.

In an exemplary embodiment, cover 128 has an inner surface that faces the cartridge bay 122 when closed and an outer surface in contact with the wrist of the consumer 202. The inner surface having a debossed spray canister profile shape 124 therein that snugly fits around the spray canister 108 preventing the canister from slipping or rotating when the cover is closed.

In an exemplary embodiment, cover 128 has an integrally formed tab 116 along the perimeter edge that effectuates the ability to open cover 128 by pulling the tab 116. The band 110 has a tab recess 136 for receiving the tab 116 at the base of the body 102 when cover 128 is closed.

In an exemplary embodiment, cover 128 has an inner surface that faces the cartridge bay 122 when cover 18 is closed and an outer surface that is in contact with the wrist of the consumer 202. Cover 128 comprises a plurality of flexible pegs 126 that are integrally formed and extend from the inner surface for cover 128. The plurality of flexible pegs 126 is positioned proximate to the perimeter of the cover 128. The plurality of flexible pegs 126 is better illustrated in at least FIG. 8.

A plurality of flexible peg receptacles 132 are integrally formed on the interior surface 162 around the periphery of the cartridge bay 122. The plurality of flexible pegs 126 engages with the plurality of flexible peg receptacles 132 to fasten the cover 128 closed on the back surface 162 of the wristband 100.

Figure 8:
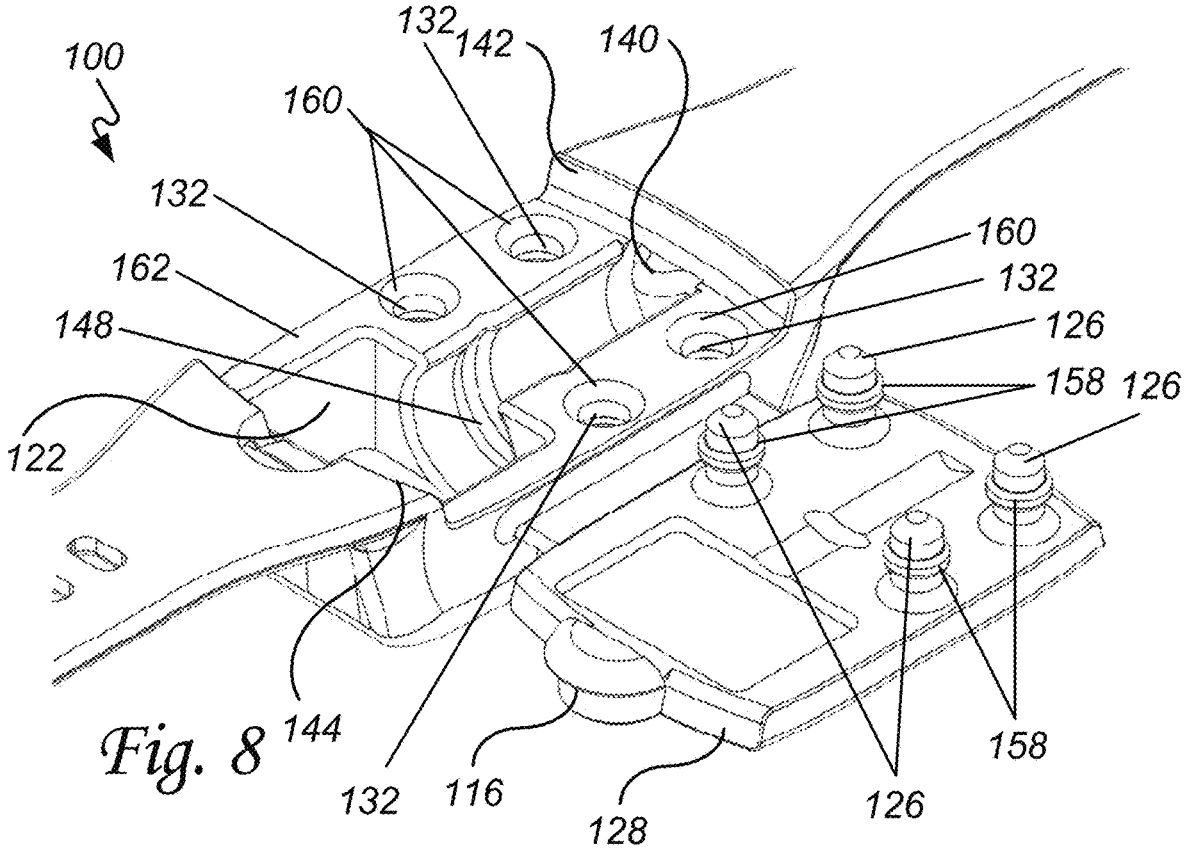
FIG. 8 illustrates one example of a bottom perspective view of a wearable self-defense spray system.
Figure 9:
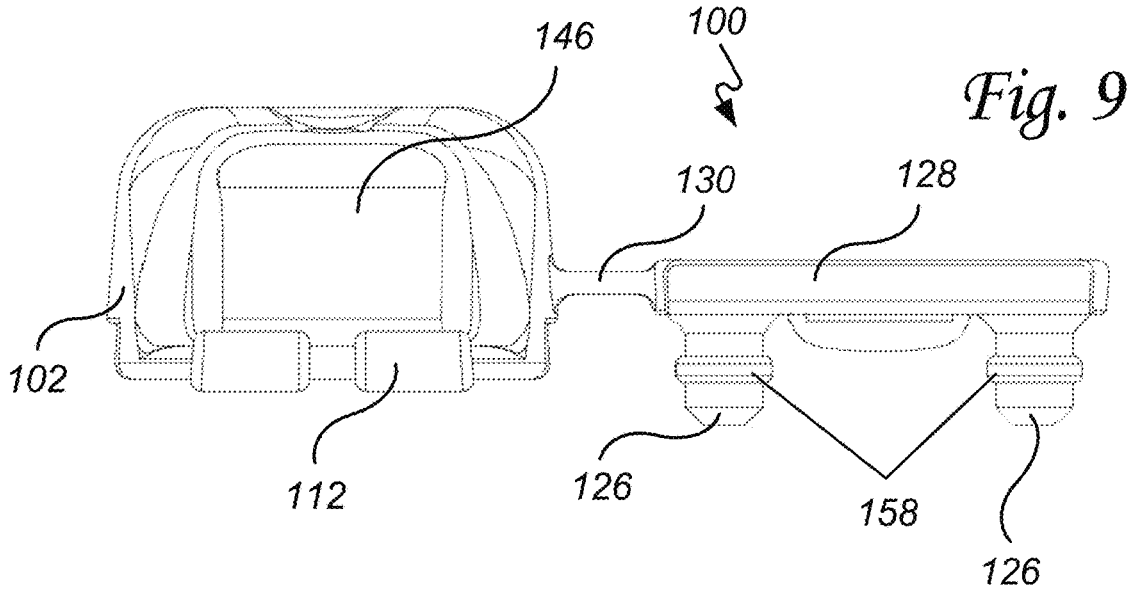
FIG. 9 illustrates one example of an end elevation view of a wearable self-defense spray system.

In another exemplary embodiment and with reference to at least FIGS. 6, 8, and 9, at least some of the plurality of flexible pegs 126 can further comprise a rib 158 integrally formed around the circumference of plurality of the flexible pegs 126.

A plurality of flexible peg receptacles 132 is integrally formed on the interior surface 162 of the body 102 around the periphery of the cartridge bay 122 that match the location of the plurality of the flexible peg receptacles 132 when the cover 128 is closed. In this regard, at least some of the plurality of flexible peg receptacles 132 further comprises a retaining band 160 that is integrally formed around the interior circumference of the plurality of flexible peg receptacles 132 such that the rib 158 of the plurality of flexible pegs 126 engages each of the retaining bands 160 of the plurality of flexible peg receptacles 132 and fastens the cover 128 closed on the back surface 162 of the wristband 100 by pressing the ribs 158 past the retaining bands 160. The retaining bands 160 preventing the ribs from egressing the plurality of flexible peg receptacles 132 unless tab 116 is pulled by the consumer 202 in which case the ribs 158 slip past the retaining bands 160 allowing the cover 128 to be opened.

In an exemplary embodiment, the band 110 has a first contoured edge 144 that is recessed where it is integrally formed with the body 102, and the clasp 112 has a second contoured edge 142 that is recessed where it is integrally formed with the body 102 such that when the cover 128 is closed it rests on the back surface 162 and is co-planer with the band 110 and the clasp 112 as to lay flat against the wrist of the consumer 202. The first contoured edge 144 and the second contoured edge 142 are also illustrated in at least FIG. 8.

Figure 7:
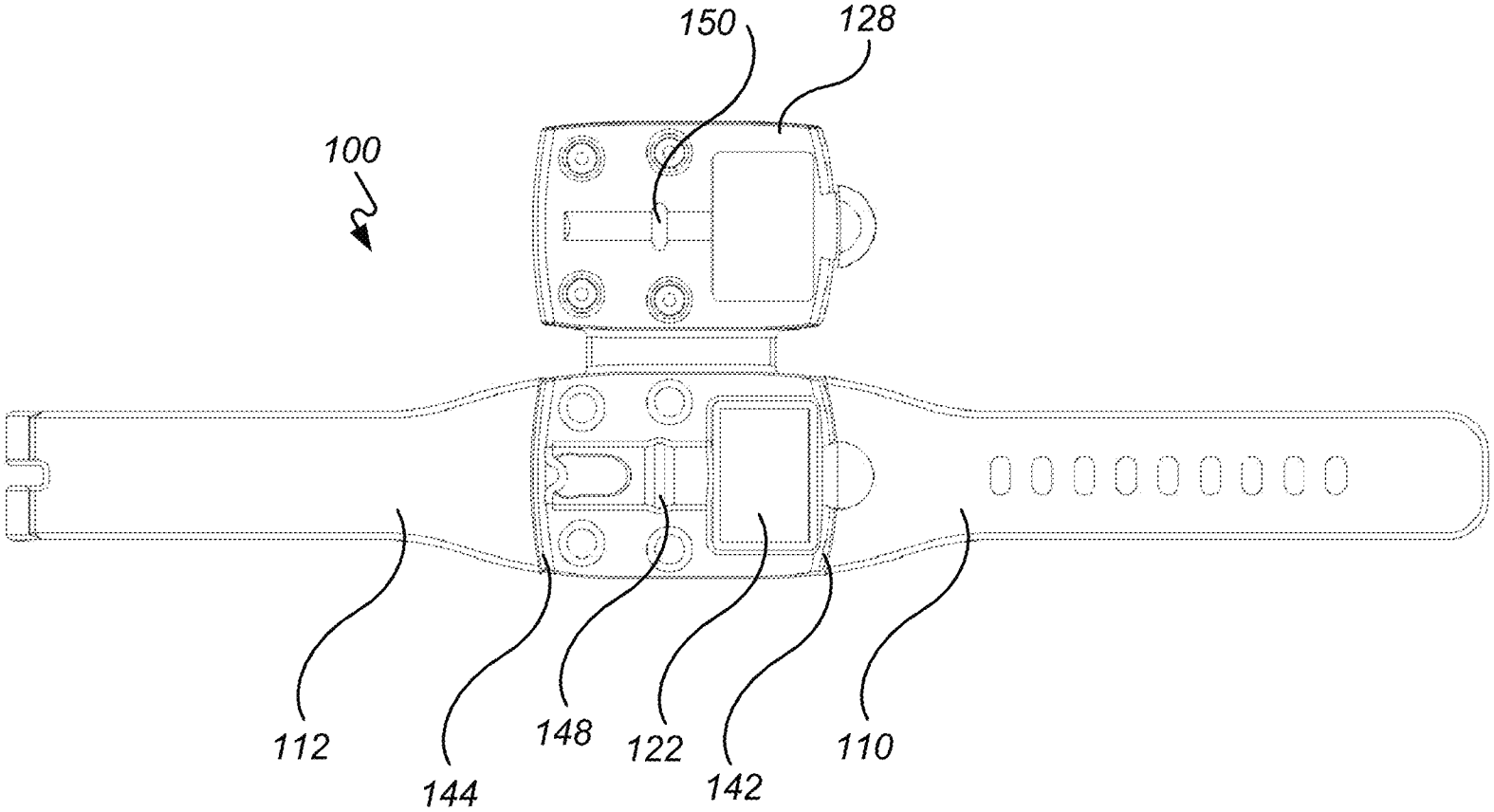
FIG. 7. illustrates one example of a back elevation view of a wearable self-defense spray system.

Referring to FIG. 7, there is illustrated one example of a back elevation view of a wearable self-defense spray system 100. In an exemplary embodiment, a concave neck guide 150 is integrally formed on the interior surface of cover 128. The concave neck guide 150 engages the neck ring 106 of the spray canister when inserted into the cartridge bay 122 and cover 128 is closed. The concave neck guide 150 engaging the neck ring 106 to prevent slip or rotation of the spray canister 108 during activation by the consumer 202.

Referring to FIG. 8, there is illustrated one example of a bottom perspective view of a wearable self-defense spray system 100 enlarged to show details and surface features.

In an exemplary embodiment, the wearable self-defense spray system 100 can comprise a wristband 100 having a body 102 with a front exterior surface, and an interior surface 162, a cartridge bay 122, and a cover 128 that fastens across the interior surface 162 to seal the body closed.

The front exterior surface 102 has an egress aperture 134 therethrough that extends into the cartridge bay 122. Cover 128 comprises a plurality of flexible pegs 126 positioned proximate to the perimeter of cover 128. A rib 158 is integrally formed around the circumference of the plurality of the flexible pegs 126. A plurality of flexible peg receptacles 132 are integrally formed on the interior surface 162 around the periphery of the cartridge bay 122. A retaining band 160 is integrally formed around the interior circumference of the plurality of flexible peg receptacles 132. The rib 158 engages and slides past the retaining band 160 fastening the cover 128 closed on the interior surface 162 of the wristband. The retaining band 160 prevents rib 158 from egressing the plurality of flexible peg receptacles 132 until consumer 202 pulls the cover 18 open.

A spray canister 108 comprises a spray valve 138 having an egress port 104, and a self-defense spray liquid 402 inside the spray canister 108. The spray canister is pressurized with inert gas, refrigerants such as freon, R-134A, or other refrigerants, butane, or other suitable propellants and is profiled in shape to snuggly fit into the cartridge bay 122 in a non-slip, non-rotating manner. The egress port 104 is orientated such that by depressing the spray valve the self-defense spray liquid 402 egresses the spray canister 108 through the egress port 104 and the egress aperture 134, wherein the self-defense spray liquid 402 can be sprayed by the consumer in the direction of a threat 502 such as a person, animal, or other threat by pressing the spray valve 138.

Referring to FIG. 9, there is illustrated one example of an end elevation view of a wearable self-defense spray system 100 enlarged to show details and surface features.

Figure 10:
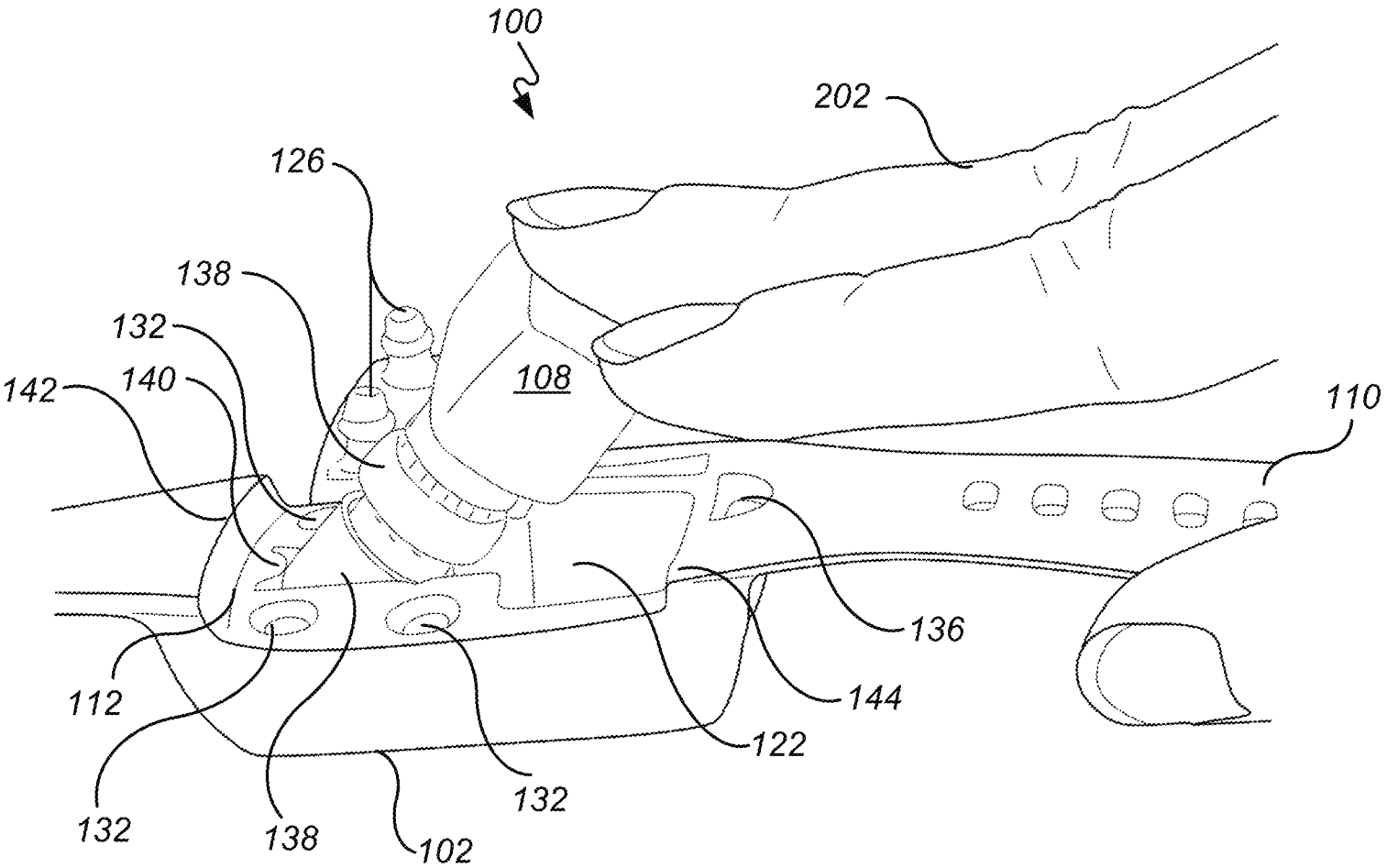
FIG. 10 illustrates one example of a spray canister being inserted into the cartridge bay of a wristband.

Referring to FIG. 10, there is illustrated one example of a spray canister 108 being inserted into the cartridge bay 122 of a wristband 100. In an exemplary embodiment, the spray canister 108 can be angled downward to insert the spray nozzle 138 portion first. The main spray canister 108 body can then be pressed flat into the canister bay 122. The egress port 104 is aligned with the egress aperture 134 so the during activation by the consumer the self-defense spray liquid 104 can be dispensed from the spray canister by way of the egress port 104 without contacting or being encumbered by the wrist band 100.

When the self-defense spray liquid 104 has been dispensed the consumer 202 can replace the spray canister 108 by lifting the spray canister 108 body from the cartridge bay 122 and slidable removing, replacing it with a new spray canister 108.

Figure 11:
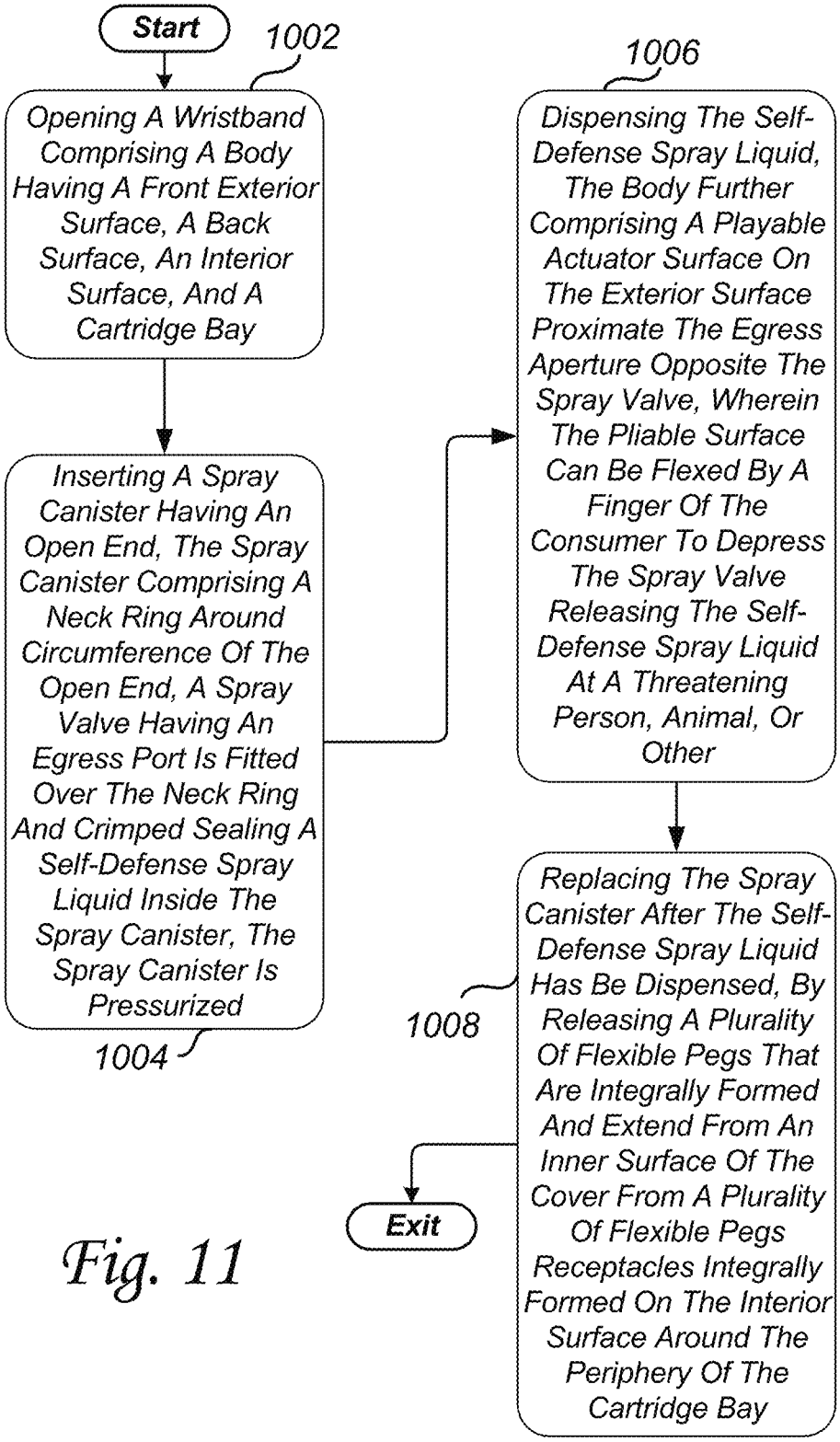
FIG. 11 illustrates one example of a method of using a wearable self-defense spray system.

Referring to FIG. 11 there is illustrated one example of a method of using a wearable self-defense spray system. In an exemplary embodiment, the method start is step 1002 by opening a wristband 100. The wristband comprising a body 102 having a front exterior surface, and a back surface. An interior surface comprises a cartridge bay 122.

A band 110 attaches to one end of the body 102. The band 110 has a plurality of holes 114 disposed along the length of the band 110. A clasp 112 attaches to the opposite end of the body 102. The band 110 and the clasp 112 interconnect to secure the wristband 100 around a wrist of a consumer 202.

A cover fastens across the back interior surface 162 to seal the body 102 closed. The front exterior surface 102 has an egress aperture 134 therethrough that extends into the cartridge bay 122. The method moves to step 1004.

In step 1004, a spray canister is inserted into cartridge bay 122. The spray canister 108 has an open end 152. The spray canister comprising a neck ring 106 around the outer circumference of the open end 152.

A spray valve 138 has an egress port 104. The spray valve 138 is fitted over the neck ring 106 of the spray canister 108 and crimped, sealing a self-defense spray liquid 104 inside the spray canister 108. The spray canister is pressurized and is profiled in shape to snuggly fit into the cartridge bay 122 in a non-slip, non-rotating manner. The egress port 104 is orientated in a manner that when the spray valve 138 is depressed the self-defense spray liquid 104 egresses the spray canister 108 through the egress port 104 and the egress aperture 134. The method moves to step 1006.

In step 1006, the self-defense spray liquid is dispensed. The body 102 further comprises a pliable actuator surface 146 on the exterior surface proximate the egress aperture 134 opposite the spray valve 138. When the pliable actuator surface 146 is flexed by a finger of the consumer 202 the spray valve 138 is depressed releasing the self-defense spray liquid 104 at a threat 502 such as a person, animal, or other threat. The method moves to step 1008.

In step 1008, the spray canister 108 can be replaced after the self-defense spray liquid has been dispensed, by releasing a plurality of flexible pegs 126 that are integrally formed and extend from an inner surface of the cover 128 from a plurality of flexible peg receptacles 132 that are integrally formed on the interior surface 162 around the periphery of the cartridge bay 122, such that when the cover 128 is opened the spray canister 108 can be removed from the cartridge bay 122 and replaced with a new spray canister 108.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A wearable self-defense spray system comprising:

a wristband comprising a body having a front exterior surface, and an interior surface, a cartridge bay, and a cover that fastens across the interior surface to seal the body closed, the front exterior surface having an egress aperture therethrough that extends into the cartridge bay, the cover comprising a plurality of flexible pegs positioned proximate the perimeter of the cover, a rib is integrally formed around the circumference of the plurality of the flexible pegs, a plurality of flexible peg receptacles are integrally formed on the interior surface around the periphery of the cartridge bay, a retaining band is integrally formed around the interior circumference of the plurality of flexible peg receptacles, the rib engages sliding past the retaining band fastening the cover closed on the interior surface of the wristband, the retaining band prevents the rib from egressing the plurality of flexible peg receptacles until a consumer pulls the cover open; and a spray canister comprising a spray valve having an egress port, and a self-defense spray liquid inside the spray canister, the spray canister is pressurized and is profiled in shape to snuggly fit into the cartridge bay in a non-slip, non-rotating manner, the egress port is orientated such that by depressing the spray valve the self-defense spray liquid egresses the spray canister through the egress port and the egress aperture, wherein the self-defense spray liquid can be sprayed by the consumer in a direction of a threat such as a person, animal, or other threat by pressing the spray valve.

2. The system in accordance with claim 1, the wristband is made from one or more of the following materials an elastomer, polymer, neoprene, rubber, cloth, plastic, or leather.

3. The system in accordance with claim 1, the body further comprising a pliable actuator surface on the exterior surface proximate the egress aperture opposite the spray valve, wherein the pliable actuator surface can be flexed by a finger of the consumer to depress the spray valve releasing the self-defense spray liquid.

4. The system in accordance with claim 1, the cartridge bay having a raised neck ridge integrally formed along the surface of the cartridge bay, wherein when the spray canister is inserted into a cartridge bay the raised neck ridge engages a contoured shoulder of the spray canister preventing it from sliding away from a force of a finger of the consumer when the spray nozzle is pressed.

5. The system in accordance with claim 1, the wristband and spray canister are scaled in dimension to fit around a finger of the consumer as a ring.

6. The system in accordance with claim 1, the wristband is hung on a cord or chain and worn as a necklace around neck of the consumer.

7. A wearable self-defense spray system comprising:

a wristband comprising a body having a front exterior surface, a back surface, and an interior surface comprising a cartridge bay, a band is attached to one end of the body having a plurality of holes disposed along a length of the band, a clasp is attached to an opposite end of the body, the band and the clasp interconnect to secure the wristband around a wrist of a consumer, a cover fastens across the back surface to seal the body closed, the front exterior surface having an egress aperture therethrough that extends into the cartridge bay; and a spray canister having an open end, the spray canister comprising a neck ring around the open end, a spray valve having an egress port that is fitted over the neck ring and crimped sealing a self-defense spray liquid inside the spray canister, the spray canister is pressurized and is profiled in shape to snuggly fit into the cartridge bay in a non-slip, non-rotating manner, the egress port is orientated such that by depressing the spray valve the self-defense spray liquid egresses the spray canister through the egress port and the egress aperture, wherein the self-defense spray liquid can be sprayed by the consumer in a direction of a threat such as a person, animal, or other threat by pressing the spray valve.

8. The system in accordance with claim 7, the cartridge bay having a spray nozzle end and a canister end, the spray nozzle end having a nozzle tab that extends from a perimeter of the interior surface to cover a portion of the spray canister nozzle, wherein the nozzle tab applies pressure to hold the spray nozzle tight within the cartridge bay when the cover is closed.

9. The system in accordance with claim 7, the cartridge bay having a raised neck ridge integrally formed along the surface of the cartridge bay wherein when the spray canister is inserted into the cartridge bay the raised neck ridge engages a contoured shoulder of the spray canister preventing it from sliding away from a force of a finger of the consumer when the spray nozzle is pressed.

10. The system in accordance with claim 7, the body further comprising a pliable actuator surface on the exterior surface proximate the egress aperture opposite the spray valve, wherein the pliable actuator surface can be flexed by a finger of the consumer to depress the spray valve releasing the self-defense spray liquid.

11. The system in accordance with claim 7, an integrally formed hinge connects one edge of the cover with one edge of the body, wherein the cover remains flexibly attached and is repositionable to open and close the cartridge bay.

12. The system in accordance with claim 7, the cover having an inner surface that faces the cartridge bay and an outer surface in contact with the wrist of the consumer, the inner surface having a debossed spray canister profile shape therein that snugly fits around the spray canister preventing the canister from slipping or rotating when the cover is closed.

13. The system in accordance with claim 7, the cover having an integrally formed tab along a perimeter edge that effectuates the ability to open the cover by pulling the tab, the band having a tab recess at the base of the body for receiving the tab when the cover is closed.

14. The system in accordance with claim 7, the cover having an inner surface that faces the cartridge bay and an outer surface in contact with the wrist of the consumer, the cover comprising a plurality of flexible pegs that are integrally formed and extend from the inner surface, the plurality of flexible pegs is positioned proximate a perimeter of the cover.

15. The system in accordance with claim 14, at least some of the plurality of flexible pegs further comprises a rib integrally formed around a circumference of the plurality of the flexible pegs, the plurality of flexible pegs are positioned proximate to the perimeter of the cover, a plurality of flexible peg receptacles are integrally formed on the interior surface around the periphery of the cartridge bay, at least some of the plurality of flexible peg receptacles further comprises a retaining band integrally formed around the interior circumference of the plurality of flexible peg receptacles, wherein each of the rib engages sliding past each of the retaining band fastening the cover closed on the back surface of the wristband, wherein the retaining band prevents the rib from egressing the plurality of flexible peg receptacles until the consumer pulls the cover open.

16. The system in accordance with claim 14, a plurality of flexible peg receptacles integrally formed on the interior surface around the periphery of the cartridge bay, the plurality of flexible pegs engaging with the plurality of flexible peg receptacles to fasten the cover closed on the back surface of the wristband.

17. The system in accordance with claim 7, the band having a first contoured edge that is recessed where it is integrally formed with the body and the clasp having a second contoured edge that is recessed where it is integrally formed with the body wherein the cover when closed rests on the back surface and is co-planer with the band and the clasp as to lay flat against the wrist of the consumer.

18. The system in accordance with claim 7, the wristband and spray canister are scaled in dimension to fit around a finger of the consumer as a ring, or the wristband is hung on a cord or chain and worn as a necklace around neck of the consumer.

19. A method of using a wearable self-defense spray system comprising the steps of:

opening a wristband comprising a body having a front exterior surface, a back surface, an interior surface comprising a cartridge bay, a band attaches to one end of the body having a plurality of holes disposed along the length of the band, a clasp attaches to the opposite end of the body, the band and the clasp interconnect to secure the wristband around a wrist of a consumer, a cover fastens across the back surface to seal the body closed, the front exterior surface having an egress aperture therethrough that extends into the cartridge bay;

inserting a spray canister having an open end, the spray canister comprising a neck ring around the outer circumference of the open end, a spray valve having an egress port is fitted over the neck ring and crimped, sealing a self-defense spray liquid inside the spray canister, the spray canister is pressurized and is profiled in shape to snuggly fit into the cartridge bay in a non-slip, non-rotating manner, the egress port is orientated such that by depressing the spray valve the self-defense spray liquid egresses the spray canister through the egress port and the egress aperture; and dispensing the self-defense spray liquid, the body further comprising a pliable actuator surface on the exterior surface proximate the egress aperture opposite the spray valve, wherein the pliable actuator surface is flexed by a finger of the consumer to depress the spray valve releasing the self-defense spray liquid at a threat such as a person, animal, or other threat.

20. The method in accordance with claim 19, further comprising the step:

replacing the spray canister after the self-defense spray liquid has been dispensed, by releasing a plurality of flexible pegs that are integrally formed and extend from an inner surface of the cover from a plurality of flexible peg receptacles that are integrally formed on the interior surface around the periphery of the cartridge bay, wherein when the cover is opened the spray canister can be removed from the cartridge bay and replaced with a new spray canister.

* * * * *